313-414 SR
5/20/86 OR 4,590,403

United States Patent [19]
Alig

[11] Patent Number: 4,590,403
[45] Date of Patent: May 20, 1986

[54] COLOR PICTURE TUBE HAVING AN IMPROVED INLINE ELECTRON GUN

[75] Inventor: Roger C. Alig, West Windsor Township, Mercer County, N.J.

[73] Assignee: RCA Corporation, Princeton, N.J.

[21] Appl. No.: 646,117

[22] Filed: Aug. 31, 1984

[51] Int. Cl.[4] ..... H01J 29/50; H01J 29/62
[52] U.S. Cl. ..... 313/414; 313/449; 313/460
[58] Field of Search ..... 313/414, 449, 460, 458, 313/412, 409

[56] References Cited

U.S. PATENT DOCUMENTS

| | | | |
|---|---|---|---|
| 2,714,176 | 7/1955 | Friend | 315/17 |
| 2,726,347 | 12/1955 | Benway | 313/70 |
| 2,726,348 | 12/1955 | Benway | 313/70 |
| 2,861,208 | 11/1958 | Benway | 313/70 |
| 3,011,090 | 11/1961 | Moodey | 315/13 |
| 3,024,380 | 3/1962 | Burdick et al. | 313/70 |
| 3,873,879 | 3/1975 | Hughes | 315/13 C |
| 4,388,552 | 6/1983 | Greninger | 313/414 |
| 4,400,649 | 8/1983 | Chen | 313/414 |

*Primary Examiner*—David K. Moore
*Assistant Examiner*—K. Wieder
*Attorney, Agent, or Firm*—Eugene M. Whitacre; Dennis H. Irlbeck

[57] ABSTRACT

An improved color picture tube has an inline electron gun for generating and directing three electron beams, a center beam and two side beams, along coplanar paths toward a screen of the tube. The gun includes prefocus lens electrodes and main focus lens electrodes for focusing the electron beams. The main focus lens is formed by two spaced electrode members. The improvement includes the combination of features related to these two electrode members. One of the electrodes forming the main focus lens is an internal conductive coating on the neck. The other electrode includes three parts. First, there is a cylindrical portion that is smaller in diameter than the neck and is located in overlapped relation with respect to the conductive internal coating. Second, an apertured portion of the electrode includes three inline apertures which are aligned with the electron beam paths. And third, means are located between the cylindrical and apertured portions for controlling the astigmatism of the focus of the two side beams.

3 Claims, 4 Drawing Figures

Fig. 1
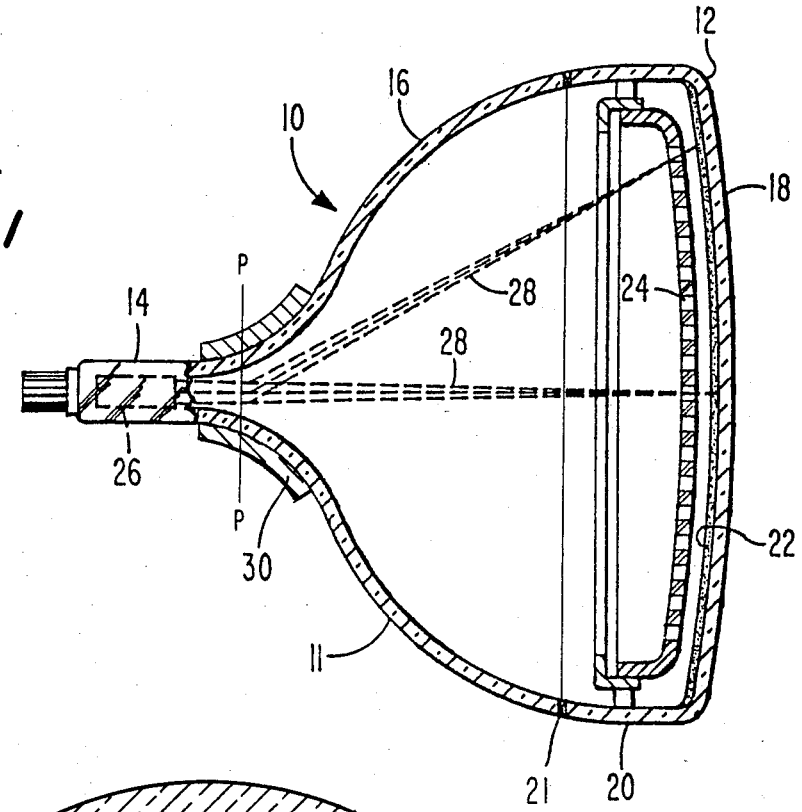
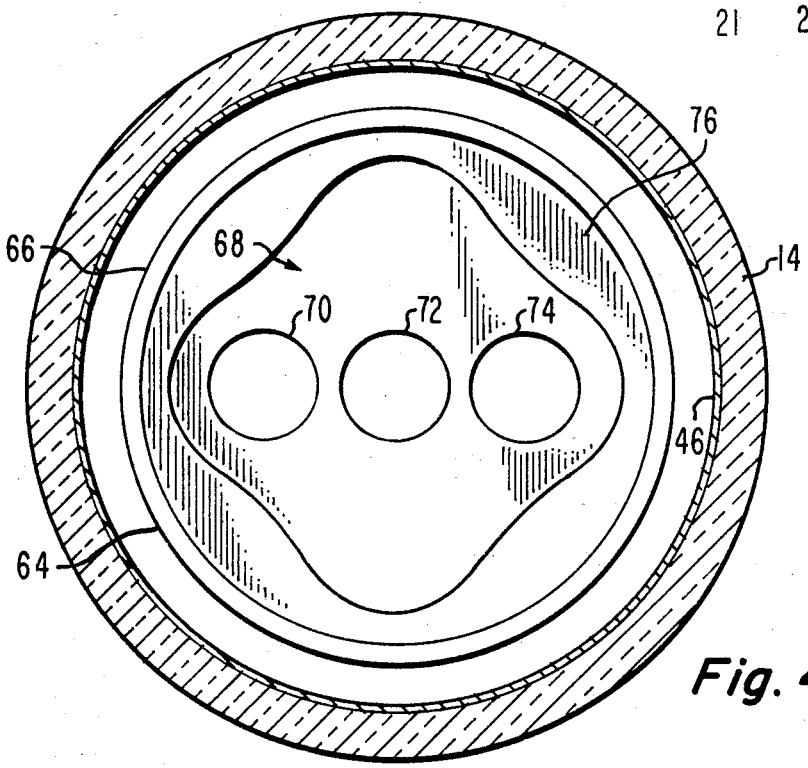
Fig. 4

COLOR PICTURE TUBE HAVING AN IMPROVED INLINE ELECTRON GUN

BACKGROUND OF THE INVENTION

The present invention relates to color picture tubes having improved inline electron guns and particularly to such guns using a tube neck coating as one of the gun electrodes.

An inline electron gun is one designed to generate or initiate preferably three electron beams in a common plane and direct those beams along convergent paths to a point or small area of convergence near the tube screen. In one type of inline electron gun, shown in U.S. Pat. No. 3,873,879, issued to R. H. Hughes on Mar. 25, 1975, the main electrostatic focusing lens for focusing the electron beams is formed between two electrodes referred to as the first and second accelerating and focusing electrodes. These electrodes include two cup-shaped members having their bottoms facing each other. Three apertures are included in each cup bottom to permit passage of three electron beams and to form three separate main focus lenses, one for each electron beam. In a preferred embodiment, the overall diameter of the electron gun is such that the gun will fit into a 29 mm tube neck. Because of this size requirement, the three focusing lenses are very closely spaced from each other, thereby providing a severe limitation on focus lens design. It is known in the art that the larger the focus lens diameter, the lesser will be the spherical aberration which restricts the focus quality.

One means of obtaining a larger focus lens is to use an internal coating on the tube neck as the final focus electrode. Such internal coating was used commercially in single beam monochrome tubes. Internal coating electrodes of multibeam shadow mask color picture tubes are disclosed in the following U.S. Pat. Nos.

| U.S. Pat. No. | Inventor | Issued |
|---|---|---|
| 2,714,176 | Friend | July 26, 1955 |
| 2,726,347 | Benway | Dec. 6, 1955 |
| 2,726,348 | Benway | Dec. 6, 1955 |
| 2,861,208 | Benway | Nov. 18, 1958 |
| 3,011,090 | Moodey | Nov. 28, 1961 |
| 3,024,380 | Burdick et al. | Mar. 6, 1962 |

Although, apparently, considerable work was done on these multibeam tubes, such tubes were never commercially developed.

The present invention utilizes an internal coating electrode in novel combination with other electron gun features to provide an electron gun of the inline beam type which has lower focus lens aberration than other inline electron guns.

SUMMARY OF THE INVENTION

An improved color picture tube has an inline electron gun for generating and directing three electron beams, a center beam and two side beams, along coplanar paths toward a screen of the tube. The gun includes prefocus lens electrodes and main focus lens electrodes for focusing the electron beams. The main focus lens is formed by two spaced electrode members. The improvement includes the combination of features related to these two electrode members. One of the electrodes forming the main focus lens is an internal conductive coating on the neck. The other electrode includes three parts. First, there is a cylindrical portion that is smaller in diameter than the neck and is located in overlapped relation with respect to the conductive internal coating. Second, an apertured portion of the electrode includes three inline apertures which are aligned with the electron beam paths. And third, means are located between the cylindrical and apertured portions for controlling the astigmatism of the focus of the two side beams.

BRIEF DESCRIPTION OF THE DRAWINGS

FIG. 1 is a plan view, partly in axial section, of a shadow mask color picture tube embodying the invention.

FIG. 4 is a front view of a focus lens electrode of the electron gun of FIGS. 2 and 3.

DETAILED DESCRIPTION OF THE PREFERRED EMBODIMENT

Figure 3:
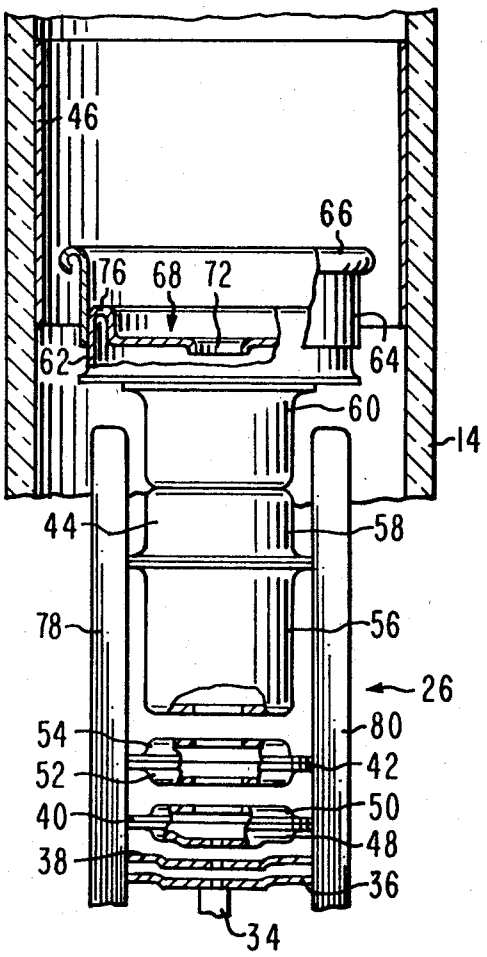
FIGS. 2 and 3 are partial axial section, top and side views, respectively, of the electron gun shown in dashed lines in FIG. 1.

FIG. 1 shows a rectangular color picture tube 10 having a glass envelope 11 cbmprising a rectangular faceplate panel 12 and a tubular neck 14 connected by a rectangular funnel 16. The panel 12 comprises a viewing faceplate 18 and a peripheral flange or sidewall 20 which is sealed to the funnel 16 with a frit seal 21. A mosaic three-color phosphor screen 22 is located on the inner surface of the faceplate 18. The screen preferably is a line screen with the phosphor lines extending substantially perpendicular to the high frequency raster line scan of the tube (normal to the plane of FIG. 1). Alternatively, the screen could be a dot screen. A multiapertured color selection electrode or shadow mask 24 is removably mounted, by conventional means, in predetermined spaced relation to the screen 22. An improved inline electron gun 26, shown schematically by dashed lines in FIG. 1, is centrally mounted within the neck 14 to generate and direct three electron beams 28 along coplanar convergent paths through the mask 24 to the screen 22.

The tube of FIG. 1 is designed to be used with an external magnetic deflection yoke, such as the yoke 30 in the neighborhood of the funnel-to-neck junction. When activated, the yoke 30 subjects the three beams 28 to magnetic fields which cause the beams to scan horizontally and vertically in a rectangular raster over the screen 22. The initial plane of deflection (at zero deflection) is shown by the line P-P in FIG. 1 at about the middle of the yoke 30. Because of fringe fields, the zone of deflection of the tube extends axially from the yoke 30 into the region of the gun 26. For simplicity, the actual curvature of the deflection beam paths in the deflection zone is not shown in FIG. 1.

Figure 2:
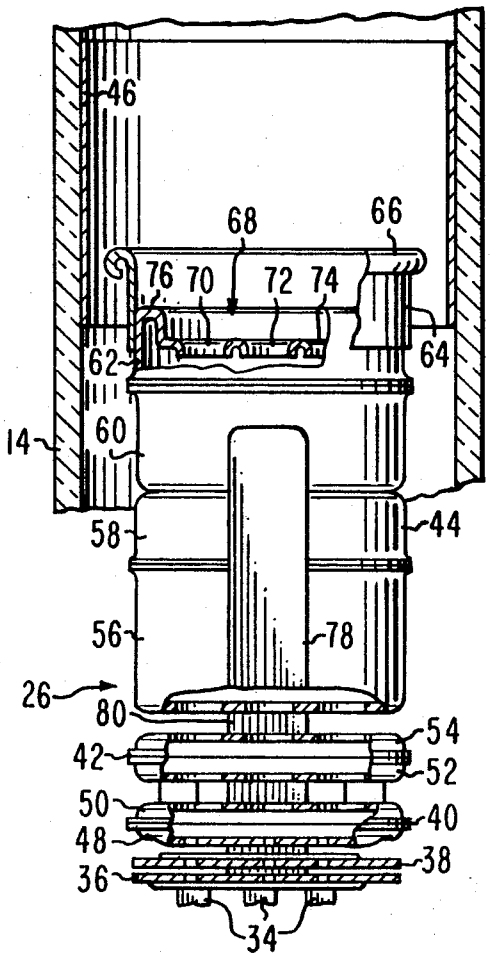

The details of the gun 26 are shown in FIGS. 2 and 3. The gun 26 comprises three equally spaced coplanar cathodes 34 (one for each beam), a control grid electrode 36 (G1), a screen grid electrode 38 (G2), a first prefocus electrode 40 (G3), a second prefocus electrode 42 (G4), a first main focus electrode 44 (G5), and a second main focus electrode 46 (G6), spaced in the order named. The G6 electrode 46 is an internal conductive coating on the neck 14. Each of the G1 through G5 electrodes has three inline apertures therein to permit passage of three coplanar electron beams. The main electrostatic focus lens in the gun 26 is formed between the G5 electrode 44 and the G6 electrode 46. The G3 electrode 40 is formed with two cup-shaped elements 48 and 50 that are connected at their open ends. Similarly, the G4 electrode is formed with two cup-shaped elements 52 and 54 that are connected at their open ends. The G5 electrode 40 is formed with four cup-shaped elements 56, 58, 60 and 62 and a cylindrical element 64. The open ends of two of these elements, 56 and 58, are attached to each other, and the open ends of the other two elements, 60 and 62, are also attached to each other. The apertured closed end of the third element 60 is attached to the apertured closed end of the second element 58. A cylindrical element 64 is peripherally attached to and extends from the apertured closed end of the element 62. The leading edge 66 of the element 64 is rolled back to aid in arc suppression. The diameter of the rolled leading edge is about half the gap between the element 64 and the G6 electrode 46. Although the G5 electrode 44 is shown as a four-piece structure, it could be fabricated from any number of elements to attain a desired length.

The apertured closed end of the element 62 of the G5 electrode 44 has a large recess 68 therein, as shown in FIG. 4. The recess 68 sets back the portion of the closed end of the G5 electrode 44 that contains three apertures, 70, 72 and 74, from the G6 electrode 46. The remaining portion of the closed end of the G5 electrode 44 forms a rim 76 that extends peripherally around the recess 68. The recess 68 in the G5 electrode 44 is substantially as wide in a direction perpendicular to the inline direction of the inline apertures 70, 72 and 74 as it is wide in the inline direction of the inline apertures. However, the recess 68 has lesser dimensions along diagonals acutely angled with respect to the inline direction of the inline apertures.

The G1 through G5 electrodes are connected by two electrically insulative support rods 78 and 80. In a preferred embodiment, the support rods are of glass, which was heated and pressed onto claws extending from the electrodes, to embed the claws in the rods.

Some typical dimensions for an electron gun, such as the electron gun 26 of FIGS. 2 and 3, are presented in the following Table. All of the dimensions in the Table are rounded to the nearest tenth of a millimeter.

TABLE

| | |
|---|---|
| External diameter of tube neck | 29.0 mm |
| Internal diameter of tube neck | 24.0 mm |
| Thicknesses of G1 electrode 36 and G2 electrode 38 | 0.1 mm |
| Length of G3 electrode 40 | 5.9 mm |
| Length of G4 electrode 42 | 8.3 mm |
| Length of G5 electrode 44 | 73.7 mm |
| Cathode 34 to G1 electrode 36 spacing | 0.08 mm |
| G1 electrode 36 to G2 electrode 38 spacing | 0.3 mm |
| G2 electrode 38 to G3 electrode 40 spacing | 1.2 mm |
| G3 electrode 40 to G4 electrode 42 spacing | 1.3 mm |
| G4 electrode 42 to G5 electrode 44 spacing | 1.3 mm |
| Center-to-center spacing between adjacent ones of apertures 70, 72, 74 in G5 electrode 44 | 6.6 mm |
| Inner diameter of apertures 70, 72 and 74 in G5 electrode 44 | 5.4 mm |
| G5 electrode 44 terminus (cylindrical element 64) diameter | 19.1 mm |
| Maximum horizontal and vertical width dimensions of recess 68 in G5 electrode 44 | 18.6 mm × 18.6 mm |
| Depth of recess 68 in G5 electrode 44 | 6.4 mm |
| G5 electrode 44 depth from edge 66 to apertured portion | 8.9 mm |

TABLE-continued

| | |
|---|---|
| Voltage on G3 electrode 40 and G5 electrode 44 | 8KV |
| Voltage on G4 electrode 42 | 2.6KV |
| Voltage on G6 electrode 46 | 25KV |

The terminal surface of the G5 electrode 44 functions electron-optically to properly converge the outer beams and to stigmatically focus all three beams. The depth of the three apertures behind the leading edge 66 of the G5 electrode 44 regulates the convergence of the outer beams. The depth of the three apertures below the rim 76 regulates the astigmatism of the focus of the outer beams. The symmetry of the G5 electrode 44 about the center beam makes the focus of this beam nearly stigmatic. Additional control of the astigmatism and convergence of the outer beams can be obtained by varying the dimensions of the recess 68. Additional control of the astigmatism of the center beam can be obtained by these variations as well as by making the center aperture vertically elliptical or by introducing additional apertures above and below the center aperture.

The above-described electron gun 26 utilizes three different focus voltages and is, therefore, of tripotential design. The G6 electrode 46 is operated at the ultor or anode potential, e.g., 25 KV. The G3 electrode 40 is electrically connected to the G5 electrode 44, and both are operated at an intermediate focus voltage, e.g., 8 KV. The G4 electrode 42 is operated at the lowest focus voltage, e.g., 2.6 KV. The tripotential design is used to accommodate the weak focusing strength of the main focus lens occurring because a neck coating is used as the final focus electrode. The neck coating forms a larger focus lens that is weaker than smaller focus lenses for given electrode voltages. In the tripotential design of the of the novel electron gun, the weaker main focus lens is compensated for by the inclusion of a prefocus lens. Such prefocus lens is formed by the combination of the G3, G4 and G5 electrodes. The prefocus lens reduces the diameters of the electron beams as they enter the weaker, but more uniform, field of the main focus lens.

An aberration coefficient is a constant that is primarily a function of the clear or unobstructed diameter of the focus electrodes and of the focal length of the main focus lens. The aberration coefficient of the novel electron gun, in an embodiment constructed in accordance with the above Table, is 0.008 $mm^{-2}$. About 75 percent of this low coefficient comes from the prefocus section of the electron gun. This coefficient for the novel electron gun is more than five times smaller than that obtained with a standard tripotential electron gun in a 29 mm neck, such as the gun used in color picture tube type 25VELP22 manufactured by Rauland Corporation, and more than ten times less than that obtained with a standard bipotential electron gun, such as the gun used in color picture tube type 25VGDP22 manufactured by RCA Corporation.

What is claimed is:

1. In a color picture tube including a neck, a funnel and a faceplate and having an inline electron gun in said neck for generating and directing three inline electron beams, a center beam and two side beams, along coplanar paths toward a screen of said tube, said gun including two spaced electrodes which form a main focus lens for focusing said electron beams, the improvement comprising one of said electrodes being an internal conductive coating on said neck, and the other of said electrodes including a cylindrical portion smaller in diameter than said neck and located in overlapped relation with respect to said conductive internal coating, an apertured portion containing three inline apertures which are aligned with the electron beam paths, and means located between said cylindrical and apertured portions for controlling the astigmatism of the focus of the two side beams.

2. The tube as defined in claim 1, wherein said means for controlling the astigmatism of the focus of the two side beams comprises a rim extending around the three apertures of said apertured portion, said rim forming a recess which has substantially the same dimension perpendicular to the inline direction of the inline apertures as its dimension parallel to the inline direction of the inline apertures and has lesser dimensions along diagonals acutely angled with respect to the inline direction of the inline apertures.

3. In a color picture tube including a neck, a funnel and a faceplate and having an inline electron gun in said neck for generating and directing three inline electron beams, a center beam and two side beams, along coplanar paths toward a screen of said tube, said gun including two spaced focus electrodes which form a main focus lens for focusing said electron beams, the improvement comprising one of said focus electrodes being an internal conductive coating on said neck, the other of said focus electrodes including a cylindrical portion smaller in diameter than said neck and located in overlapped relation with respect to said conductive internal coating, an apertured portion containing three inline apertures which are aligned with the electron beam paths, and means located between said cylindrical and apertured portions for controlling the astigmatism of the focus of the two side beams, and a plurality of prefocus electrodes for prefocusing the electron beams before the beams enter the main focus lens.

* * * * *